US005282299A

United States Patent [19]

Tachibana et al.

[11] Patent Number: 5,282,299

[45] Date of Patent: Feb. 1, 1994

[54] DROPPER SEPARATING MECHANISM

[75] Inventors: Juro Tachibana, Matsuyama; Yoshihide Nishimura, Ehime; Hiroshi Yamada, Matsuyama, all of Japan

[73] Assignee: Teijen Seiki Co., Ltd., Osaka, Japan

[21] Appl. No.: 958,679

[22] Filed: Oct. 9, 1992

[30] Foreign Application Priority Data

Oct. 24, 1991 [JP] Japan ..... 3-275887
Oct. 24, 1991 [JP] Japan ..... 3-275888
Oct. 24, 1991 [JP] Japan ..... 3-275889

[51] Int. Cl.[5] ..... D03J 1/14
[52] U.S. Cl. ..... 28/207; 28/208
[58] Field of Search ..... 28/201, 203.1, 204, 28/205, 206, 207, 208; 139/351, 354

[56] References Cited

U.S. PATENT DOCUMENTS 3,777,339 12/1973 Fleischer et al. ..... 28/206
4,499,638 2/1985 John et al. ..... 28/207
4,543,696 10/1985 John et al. ..... 28/206
4,549,333 10/1985 Stäheli ..... 28/205
4,891,871 1/1990 Tachibana et al. ..... 28/205

FOREIGN PATENT DOCUMENTS 298616 1/1989 European Pat. Off. ..... 28/206

*Primary Examiner*—Clifford D. Crowder
*Assistant Examiner*—Larry D. Worrell, Jr.
*Attorney, Agent, or Firm*—Lane, Aitken & McCann

[57] ABSTRACT

A dropper separating mechanism comprising droppers each having an asymmetrical mountain position at an upper end thereof and alternatively superimposed in a first direction so that the asymmetrical mountain portions of two adjacent droppers do not overlap each other, a pushing member provided in a rear side of the droppers to push the droppers forward from the rear side, a pair of movable pawls provided so that they are movable in a second direction perpendicular to the first direction, the pair of movable pawls also being oscillated between a first position in which the mountain portion of a foremost dropper of the droppers is limited to move forward and a second position in which the mountain portion of the foremost dropper is separated, and a fixed pawl to limit a forward movement of a lower end of the foremost dropper.

6 Claims, 14 Drawing Sheets

DROPPER SEPARATING MECHANISM

FIELD OF THE INVENTION

The present invention relates to a dropper separating mechanism that is provided in a machine for automatically threading a dropper used for detecting thread breakage.

DESCRIPTION OF THE PRIOR ART

Before weaving can commence, a threading operation in which a heddle or dropper is threaded with a warp thread is required is a preparatory operation. Since this threading operation is a complicated one in which a great number of warp threads (e.g., several thousand threads) have to be drawn one by one through the heddle or dropper, a variety of automatic threading machines have been developed. A threading machine in which threading is mechanically performed by passing a hooked needle through a threading bore of the dropper is known as a conventional threading machine. However, the mechanical threading machine has its disadvantages in that threading cannot be performed at high speeds and a sufficient percentage of success of threading cannot be achieved.

A threading operation using air flow has lately been put to practical use. This threading machine requires a dropper separating mechanism in order to separate a dropper to a predetermined threading position quickly and certainly.

A dropper separating mechanism of the above kind is shown in FIGS. 15 and 16 by way of example. In this separating mechanism, droppers arranged in a row are pushed forward and slightly bent by pushing means and the speed of a separating operation is increased by releasing a foremost dropper of the bent droppers. FIGS. 15(*a*) and 15(*b*) show the front side of one row among a plurality of dropper rows arranged in parallel. A plurality of droppers 1 each having an asymmetrical mountain portion 1*a* are alternatively superimposed backward and forward so that the asymmetrical mountain portions 1 of two adjacent droppers do not overlap each other, as shown in FIG. 15(*a*), and supported on a dropper bar 2. The droppers supported on the dropper bar 2 are guided by guide members 4A and 4B. Then, a rearmost dropper of the dropper row is pushed forward by pushing means (not shown) and a foremost dropper of the dropper row is limited to move forward by an upper separating pawl 3 and a lower pin (not shown). Therefore, the dropper row is bent proportionally to the pressure of the pushing means. If the separating pawl 3 is rotated in the right or left direction of FIG. 15(*a*), then it is disengaged from the mountain portion 1*a* of the foremost dropper 1 and the foremost dropper 1 is released from its bent state and returns back to its straight state. At the same time, a predetermined dropper separation space is formed between the foremost dropper in the straight state and the dropper row in the bent state. As shown in FIG. 16, a cylindrical positioning member 5 is then lowered toward the foremost dropper 1, and the threading bore 1*b* of the dropper 1 is retained in a predetermined threading position by twisting and rotating the dropper 1 by a helical guide surface (not shown) formed in the inner surface of the positioning member 5.

However, the dropper separating mechanism of the above kind is constructed such that the dropper separating operation is performed by oscillating the separating pawl 3 right and left, with the condition that the droppers arranged in a row are pushed against the separating pawl 3 and the foremost dropper is limited to move forward at its upper end by the separating pawl and at its lower end by the pin. Therefore, the foremost dropper and the next dropper tend to move in the oscillation directions (i.e., right and left directions of FIG. 15(*a*)) of the separating pawl 3 due to friction forces, and there occurs a failure in the separating operation in which the separating pawl cannot be disengaged from the mountain portion 1*a* of the dropper 1. In addition, since a space corresponding to an amount of one dropper is formed immediately after the mountain portion 1*a* of the foremost dropper 1, the dropper tends to be twisted. If this twisting occurs, the separation failure will be promoted.

In addition, since in the conventional dropper separating mechanism a sufficient dropper separation space cannot be obtained, it is difficult to insert the positioning member 5 into the space between the separated dropper and the next dropper and a design of this positioning member is not easy. Also, the positioning operation is performed by inserting the inner surface of the positioning member 5 onto the dropper, so the separated dropper cannot be threaded at high speeds. If the dropper is threaded at high speeds, it will be deformed and damaged. In addition, a periodical cleaning of the inner surface of the positioning member 5 is required, so an operational efficiency is reduced.

Accordingly, it is an important object of the present invention to provide a dropper separating mechanism in which the dropper separating operation is performed accurately and effectively by preventing the dropper from getting out of position.

It is another important object of the present invention to provide a dropper separating mechanism in which the dropper separation space can be obtained sufficiently, a design of the positioning member can be facilitated, and threading can be operated at high speeds.

It is still another important object of the present invention to provide a dropper separating mechanism in which the dropper is hardly damaged even if the threading is operated at high speeds and in which a periodical cleaning of the positioning member is not required.

SUMMARY OF THE INVENTION

In accordance with one important aspect of the present invention, there is provided a dropper separating mechanism comprising droppers each having an asymmetrical mountain position at an upper end thereof and alternatively superimposed in a first direction so that the asymmetrical mountain portions of two adjacent droppers do not overlap each other, and pushing means provided in a rear side of the droppers to push the droppers forward from the rear side. In addition, a pair of movable pawls is provided so that they are movable in a second direction perpendicular to the first direction, the pair of movable pawls also being oscillated between a first position in which the mountain portion of a foremost dropper of the droppers is limited to move forward and a second position in which the mountain portion of the foremost dropper is separated. The dropper separating mechanism further comprises a fixed pawl to limit a forward movement of a lower end of the foremost dropper.

When one of the movable pawls is held in the first position, the other is held in the second position. The movable pawls are supported by arm members, respectively, which oscillate about their axes located above the droppers.

In the dropper separating mechanism described above, the droppers pushed forward by the pushing means are limited to move forward by the movable pawls and the fixed pawl, so that the droppers are bent. If in this state one of the movable pawls engaging with the foremost dropper is moved into the second position (dropper separation position), the one movable pawl is disengaged from the mountain portion of the foremost dropper and at the same time the next dropper is held in position by the other movable pawl. The foremost dropper then returns back to its straight state, so that a dropper separation is formed between the foremost dropper and the next dropper. Thus, since the dropper separating operation is performed in the direction where the dropper is difficult to move, the dropper can be prevented from getting out of position. In addition, since the movable pawls are supported by the arm members that oscillate about their axes located above the droppers, the movable pawls can also move slightly forward during the separating operation. As a result, the friction between the movable pawl and the dropper can be reduced and a failure in the separating operation thus prevented.

In accordance with another important aspect of the present invention, there is provided a dropper separating mechanism wherein a plurality of droppers are arranged in a now and a foremost dropper of the plurality of droppers is separated from the next dropper so that a predetermined dropper separation space is formed between the foremost dropper and the next dropper. The dropper separating mechanism comprises a magnetic member for attracting the foremost dropper in a direction in which the foremost dropper is separated, and a movable arm supporting the magnetic member and moving the foremost dropper attracted by the magnetic member into a predetermined position. Since the foremost dropper is attracted and held by the magnetic member supported on the movable arm and is moved into the predetermined position by a movement of the movable arm, the foremost dropper can be separated easily and quickly from the next dropper and the separation space can be obtained sufficiently. The movable arm is constructed such that the foremost dropper moved into the predetermined position is removed when the next dropper is separated and moved. Therefore, additional removing means is not needed and a dropper separating mechanism which is inexpensive and small in size can be obtained.

In accordance with yet another important aspect of the present invention, there is provided a dropper separating mechanism wherein a plurality of droppers are arranged in a row and a foremost dropper of the plurality of droppers is separated from the next dropper so that a predetermined dropper separation space is formed between the foremost dropper and the next dropper. The dropper separating mechanism comprises first and second positioning members movable toward and away from each other in a predetermined threading path. The first and second positioning members have first and second guide portions, respectively, which are inclined at a predetermined angle with respect to the threading path and engageable with the separated dropper. When the first and second positioning members are moved toward each other, the separated dropper is rotated by the first and second guide portions and is positioned so that the threading path passes through a threading bore of the separated dropper. Therefore, the dropper is hardly damaged even when the positioning members are operated at high speeds and a periodical cleaning of the positioning members is not needed since the first and second guide portions can be separated from each other.

The first positioning member further has a first stop portion extending from one end of the first guide portion, the first stop portion being adapted to limit a movement of the separated dropper at one end of the separated dropper. The second positioning member further has a second stop portion extending from one end of the second guide portion, the second stop portion being adapted to limit a movement of the separated dropper at the other end of the separated dropper. If the opposite side ends of the dropper are retained by the first and second stop portions, the dropper is held in a predetermined position. As a consequence, an accuracy in the positioning of a dropper can be enhanced.

The first and second positioning members are rotatable about shafts, respectively, so that they can be moved toward and away from each other, and the shafts cross with the threading path. Accordingly, a drive system for the positioning members can be made structurally simple.

BRIEF DESCRIPTION OF THE DRAWINGS

The above and other objects and advantages will become apparent from the following detailed description when read in conjunction with the accompanying drawings wherein:

FIG. 1(*b*) is a front view showing the first embodiment of FIG. 1(*a*);

FIG. 14(*b*) is a diagram used to explain how the dropper positioning mechanism is operated, the positioning members being held in a closed position;

FIG. 15(*b*) is a view similar to FIG. 15(*a*) but showing the foremost dropper released by the separating pawl oscillated from the position of FIG. 15(*a*) to the position of FIG. 15(*b*)

DESCRIPTION OF THE PREFERRED EMBODIMENTS

Referring to FIGS. 1–5, there is shown a first embodiment of a dropper separating mechanism in accordance with the present invention.

Figure 1A:
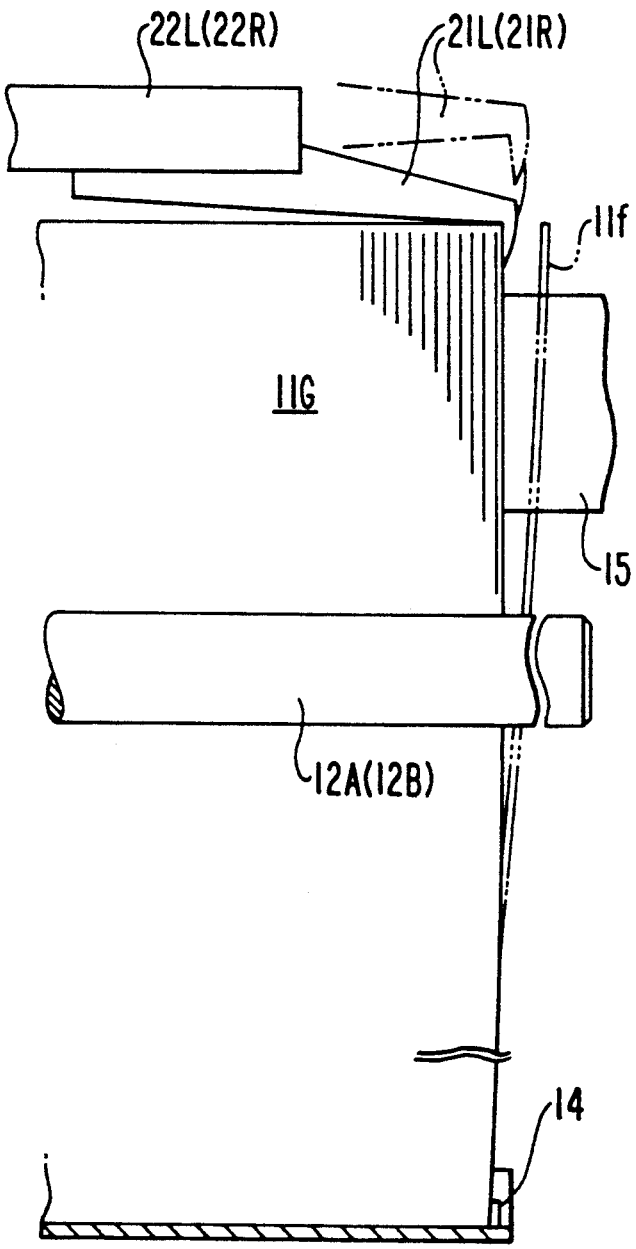
FIG. 1(*a*) is a side elevational view showing a first embodiment of a dropper separating mechanism according to the present invention.
Figure 1B:
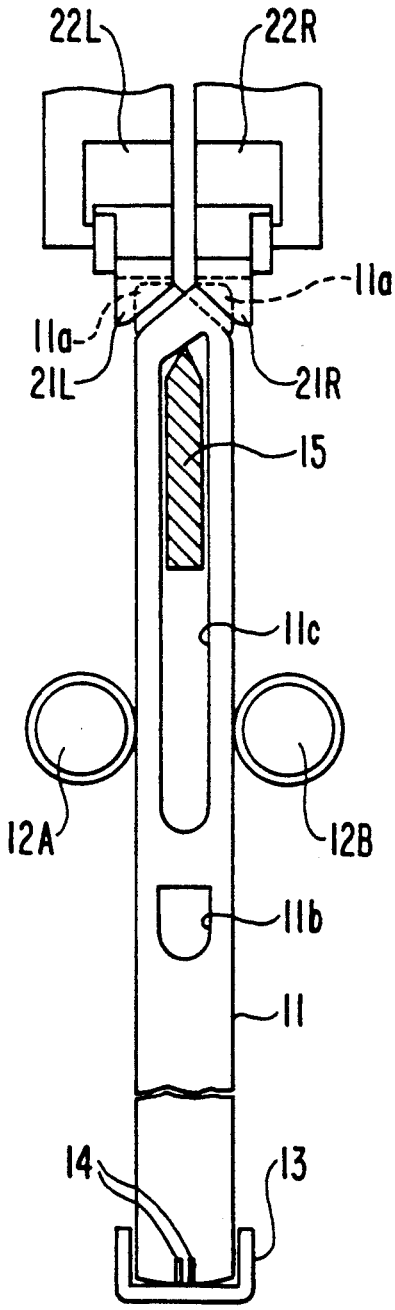

In FIGS. 1(*a*) and 1(*b*), reference numeral 11 denotes a plurality of droppers which are disposed in a predetermined position of a threading machine (the overall structure is not shown). As shown in FIG. 1(*b*), each dropper 11 is formed at its upper end with an asymmetrical mountain portion 11*a* and at its longitudinal central portion with a threading bore 11*b*. Between the asymmetrical mountain portion 11*a* and the threading bore 11*b*, the dropper 11 is further formed with an elongated bore 11*c*. A plurality of the droppers 11 are alternatively superimposed backward and forward so that the asymmetrical mountain portions 11*a* of two adjacent droppers 11 do not overlap each other, as shown in FIG. 1(*b*) and are aligned and supported on a dropper bar 15 through the elongated bores 11*c*. The aligned droppers 11 are guided by guide pins 12A and 12B and a guide rail 13 and constitute a dropper group 11G. In this embodiment, there are provided six rows of dropper groups. A rearmost dropper of each dropper group 11G is pushed with a predetermined pressure from the left direction to the right direction of FIG. 1(*a*) by a pusher or pushing means (not shown). A forward movement of the foremost dropper 11*f* is limited by a separating pawl 21L or 21R and two stop pins 14 mounted in the fore end of the guide rail 13. The two stop pins 14 are fixed pawls which are capable of limiting the forward movement of the lower end of the foremost dropper 11*f*.

The separating pawls 21L and 21R are provided in each row of droppers and are a pair of movable pawls that are movable in the dropper longitudinal direction at the front side of the foremost dropper 11*f*. The separating pawls 21L and 21R, as shown in FIG. 1(*a*), are also movable between a dropper stop position (position indicated by the solid line) in which the forward movement of the mountain portion 11*a* of the foremost dropper 11*f* is limited and a dropper separation position (position indicated by the dotted line) in which the mountain portion 11*a* of the foremost dropper 11*f* is separated from the next dropper of the dropper group 11G. If the separating pawl 21L or 21R is moved from the dropper stop position into the dropper separation position, the foremost dropper 11*f* will be changed from its bent state to its straight state, so that a predetermined dropper separation space is formed between the upper half portions of the foremost dropper 11*f* and the next dropper.

Figure 2:
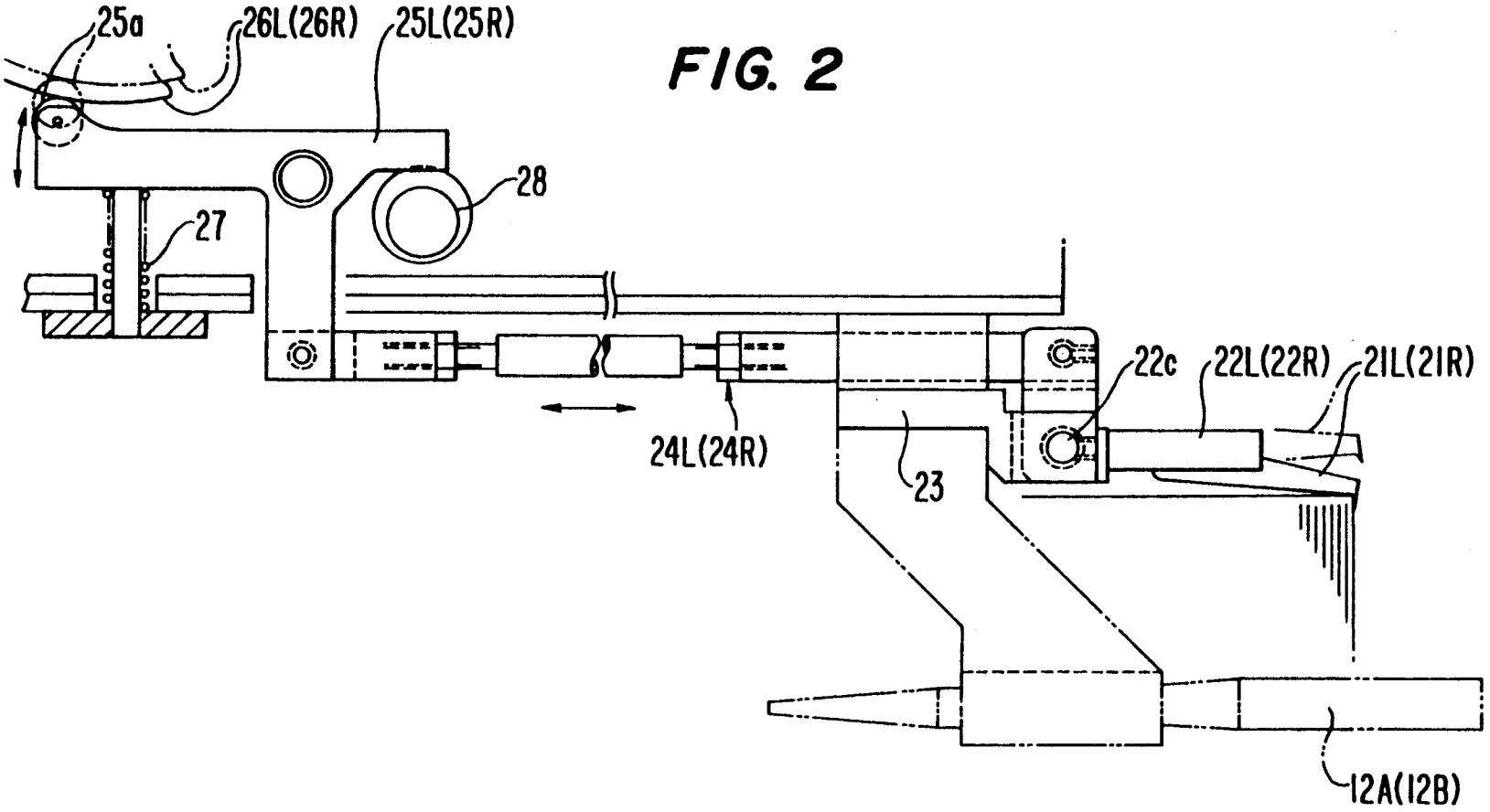
FIG. 2 is a side view showing the structure of the dropper separating mechanism of the first embodiment.
Figure 3:
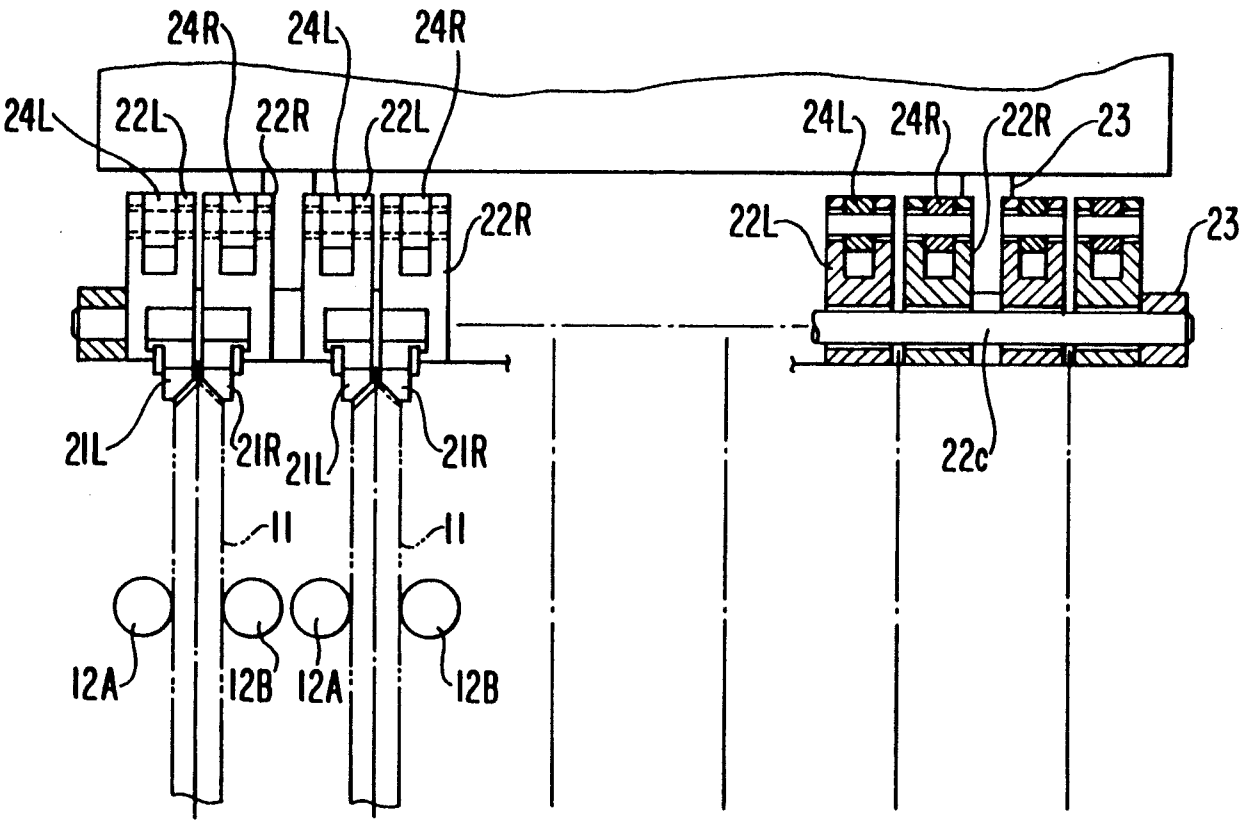
FIG. 3 is a front view of the dropper separating mechanism of FIG. 2.
Figure 4:
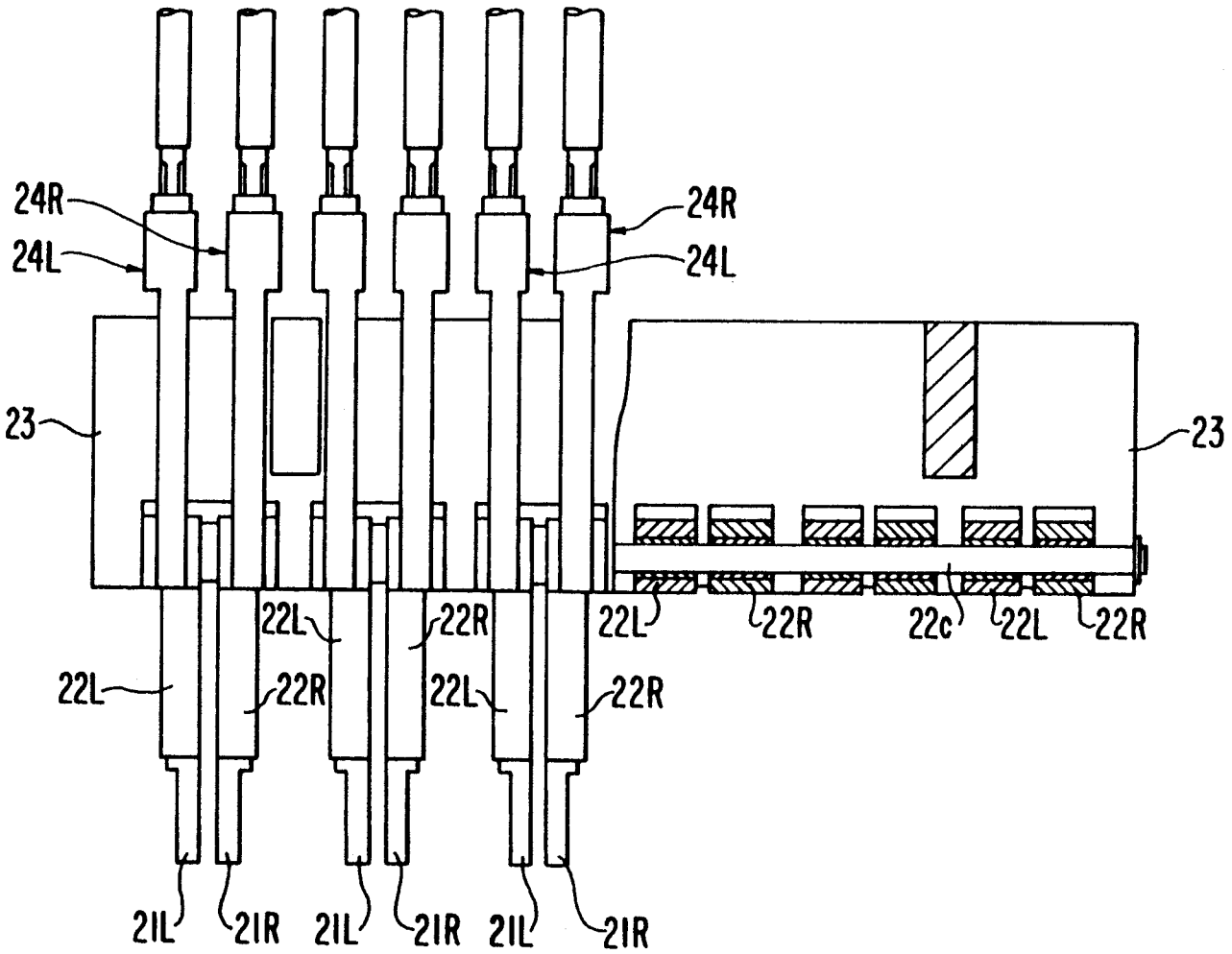
FIG. 4 is a plan view showing the dropper separating mechanism.

The separating pawls 21L and 21R, as shown in FIGS. 2–4, are carried by oscillating arms 22L and 22R, respectively, which are oscillated about an oscillation-center shaft 22*c* located above the dropper group 11G. The oscillating arms 22L and 22R are supported by a fixed frame 23 so that the oscillating arms 22L and 22R can be freely oscillated upward and downward. The fixed frame 23 is fixedly mounted on a frame structure of the above-mentioned threading machine. The oscillating arms 22L and 22R are also connected at a position above the oscillation-center shaft 22*c* to followers 25L and 25R through link members 24L and 24R. If the follower 25R engages with a pawl driving cam 26R and is rotated by rotation of the cam 26R, the separating pawl 21R will be oscillated upward and downward about the oscillation-center shaft 22*c*. Likewise, if the follower 25L engages with the pawl driving cam 26L and is rotated by rotation of the cam 26L, the separating pawl 21L will be oscillated upward and downward about the oscillation-center shaft 22*c*. The followers 25L and 25R are always urged in the clockwise direction of FIG. 2 by a spring 27 so that passive arms 25*a* of the followers are pushed against the pawl driving cams 26L and 26R. The separating pawls 21L and 21R are moved into the dropper separation positions by forces urging the followers 25L and 25R. Reference numeral 28 denotes a stopper cam which engages with the followers 25 at predetermined rotational positions and limits the movements of the followers 25 caused by the spring 27. That is, the stopper cam 28 can stop the movements of the separating pawls 21L and 21R into the dropper separation positions independently of the rotation of the pawl driving cam 26.

Figure 5:
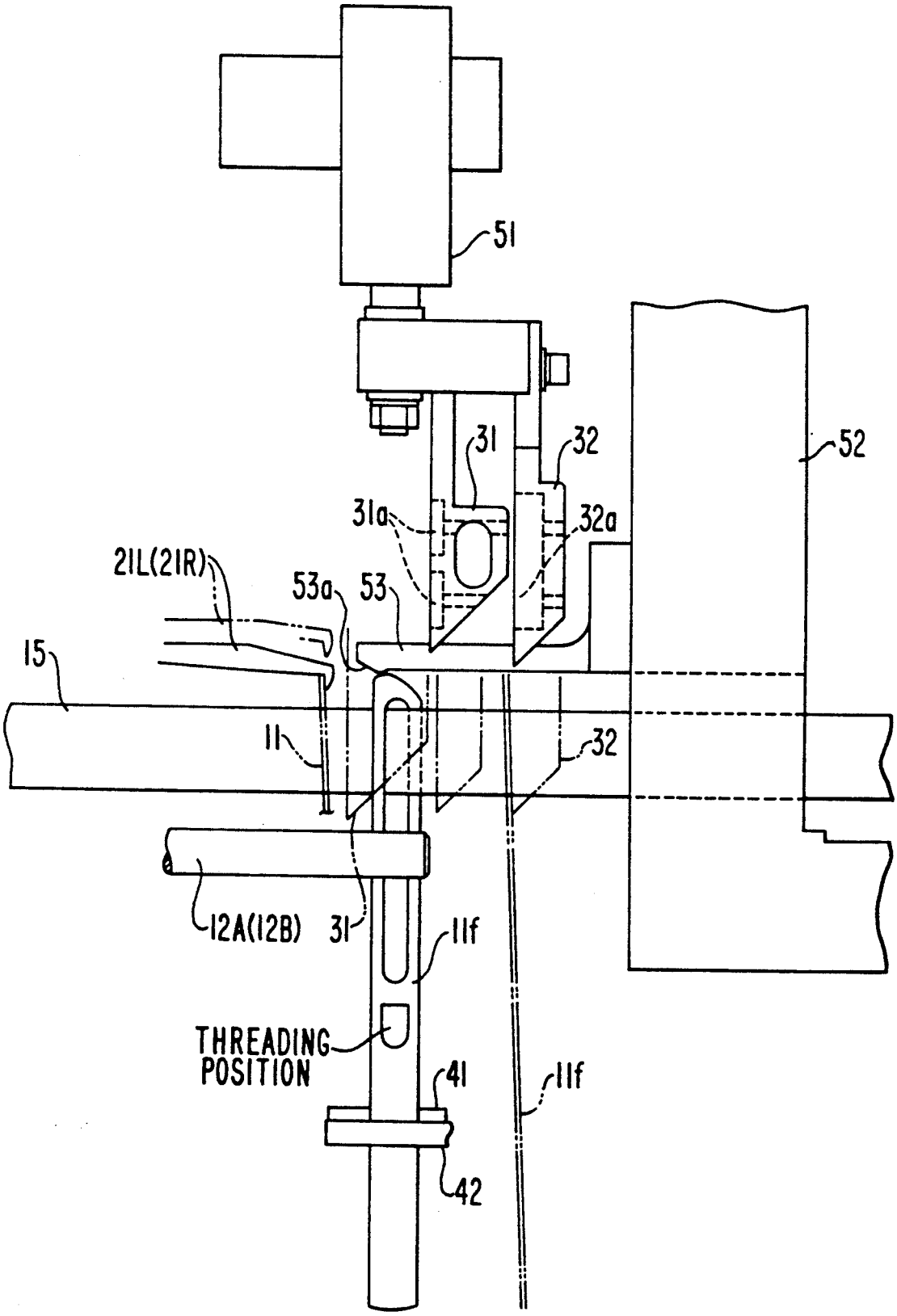
FIG. 5 is a diagram used to explain how the dropper separating mechanism is operated.
Figure 6:
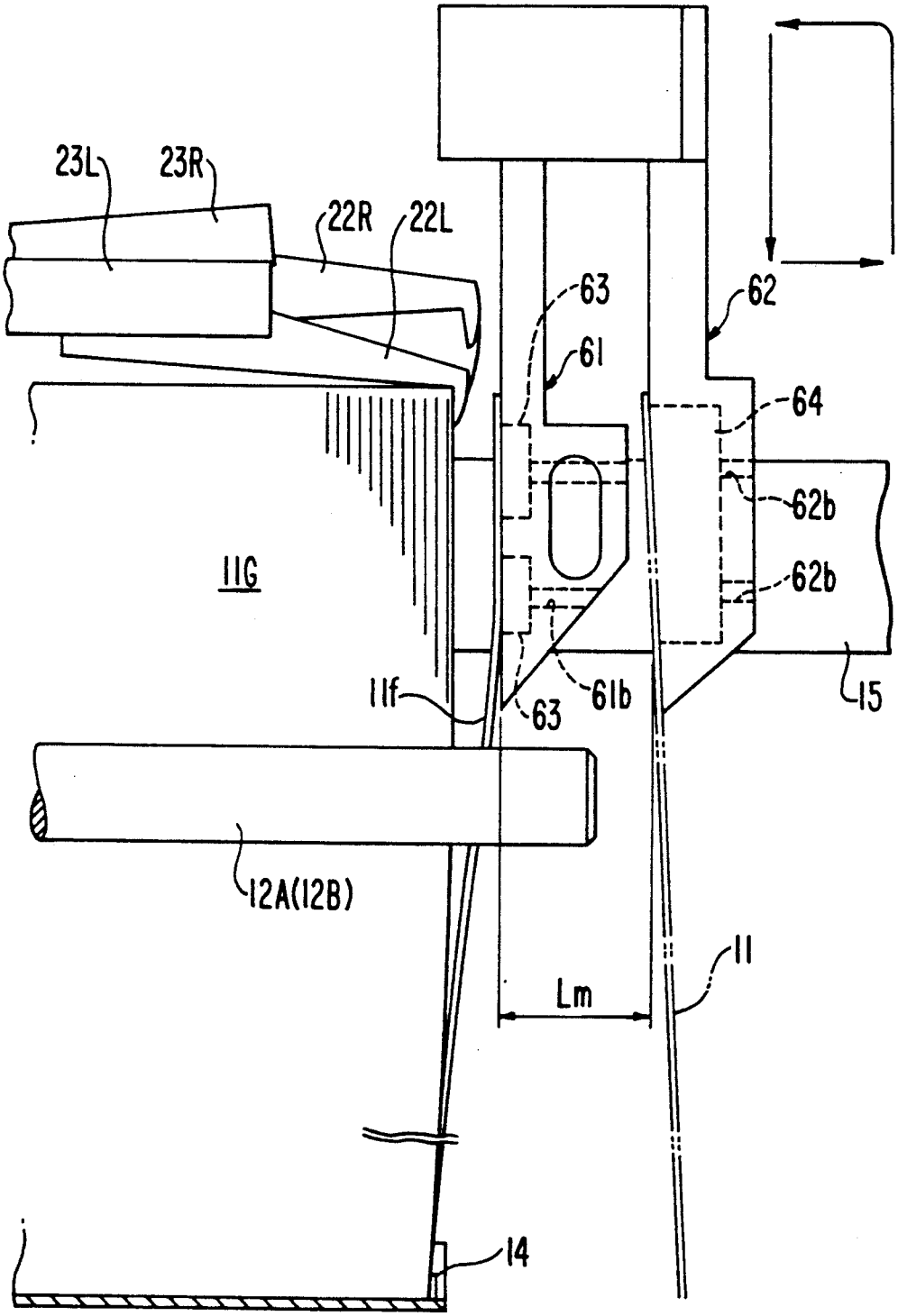
FIG. 6 is a side elevational view showing a second embodiment of the dropper separating mechanism according to the present invention.

In FIG. 5, reference numeral 31 denotes a separating arm with magnets 31*a* and 31*a*. The foremost dropper 11*f* separated from the dropper group 11G is pulled forward by the magnets 31*a* of the separating arm 31, and the dropper separation space between the upper half portions of the separated dropper 11*f* and the next dropper is further increased. A first positioning member 41 is then inserted into the increased dropper separation space. If the first positioning member 41 and a second positioning member 42 cooperating with the first positioning member 41 are driven by a drive mechanism (not shown) and come close to each other, the upper half portion of the dropper 11*f* will be horizontally rotated to the position shown in FIG. 5 and, at that time, the threading bore 11*b* of the dropper 11*f* is held in a predetermined threading position. A removing arm 32 with a magnet 32*a* is provided in front of the separating arm 31, and the arms 31 and 32 are supported on a movable frame 51 of the threading machine and movable upward and downward and also backward and forward. The threaded dropper 11*f* is attracted by the magnet 32*a* of the removing arm 32 and moved forward by the removing arm 32. Reference numeral 52 denotes a fixed frame of the threading machine supporting the dropper bar 15. The fixed frame 52 has attached thereto a return-prevention member 53 which has an engagement portion 53*a* engageable with the upper end of the separated dropper 11*f*. The separated dropper 11*f* is prevented from returning back to the dropper group 11G by the engagement portion 53*a* of the return-prevention member 53.

The operation of the dropper separating mechanism as constructed above will hereinafter be described in detail.

Prior to the operation of the threading machine, a plurality of the droppers 11 are alternatively superimposed backward and forward so that the asymmetrical mountain portions 11*a* of two adjacent droppers 11 do not overlap each other, and are aligned. The aligned droppers 11 are guided by the guide pins 12A, 12B and the guide rail 13 and supported on the dropper bar 15 through the elongated bores 11*c* of the droppers 11. Then, the rearmost dropper of this dropper group 11G are pushed forward by the pushing means, and the forward movement of the foremost dropper 11*f* is limited at the upper and lower ends thereof by one of the separating pawls 21L and 21R and by the stop pins 14 mounted in the guide rail 13. As a result, the aligned droppers 11G are bent proportionally to a pressure of the pushing means.

If in the bent state of the droppers the pawl driving cam 26 rotates, the separating pawl 21L or 21R oscillates upward and is disengaged from the mountain portion 11*a* of the foremost dropper 11*f*. The foremost dropper 11*f* is then released from its bent state and returns back to its straight state. At that time, there is formed a predetermined dropper separation space between the upper half portions of the foremost dropper 11*f* and the next dropper of the dropper group 11G.

In the separating operation, the separating pawl 21L or 21R is oscillated in the longitudinal direction of the dropper 11 and also oscillated upward and downward about the oscillation-center shaft 22*c*. Therefore, the foremost dropper 11*f* held between the stop pins 14 and the lower end of the following dropper group 11G is difficult to move in the oscillation directions of the separating pawl 21L or 21R. In addition, since the separating pawl 21L or 21R is oscillated upward while it is moving forward of the dropper 11*f*, a friction between the dropper 11*f* and the separating pawl 21L or 21R is reduced. In addition, during the time that one separating pawl 21L or 21R is moved into the dropper separation position (during the separating operation of the foremost dropper 11*f*), the forward movement of the dropper group 11G is limited by the other separating pawl 21L or 21R held in the dropper stop position and does not undergo twisting. Therefore, the foremost dropper 11*f* is prevented from getting out of position and a failure in the separating operation can be prevented. As a consequence, an operational efficiency of the threading machine is enhanced.

The dropper 11*f* separated from the dropper group 11G is attracted by the magnets 31*a* of the separating arm 31 that has been stopped forward of the dropper 11*f*, and the dropper separation space is further increased by forward movement of the separating arm 31. The positioning members 41 and 42 are then inserted into this increased dropper separation space, and moved toward each other, so that the upper half portion of the dropper 11*f* is held in the position shown in FIG. 5. At this time, the dropper 11*f* is attracted at its upper side end portion by the magnets 31*a* of the separating arm 31 and, with this condition, is horizontally rotated about this side end portion whereby the lower end of the dropper 11*f* is released from the stop pin 14.

If the positioning of the separated dropper 11*f* is completed, the threading bore 11*b* of the dropper 11*f* is positioned so that the dropper can be threaded by threading means (not shown). For example, a threading nozzle using air flow can be used as threading means. If the dropper 11*f* is threaded, then the separating arm 31 and the removing arm 32 are moved forward and upward. When the separating arm 31 and the removing arm 32 are moved by a predetermined amount and lowered again, they return back to their original stop positions and a single dropper separating operation is complete.

FIGS. 6–9 illustrate a second embodiment of the dropper separating mechanism in accordance with the present invention. Many of the parts of the second embodiment are identical to corresponding parts of the first embodiment of FIGS. 1–5 and the same reference numerals will be applied to the corresponding parts. Therefore, a description of the corresponding parts will hereinafter be omitted. The second embodiment is characterized in the structure of a separating arm.

Figure 7:
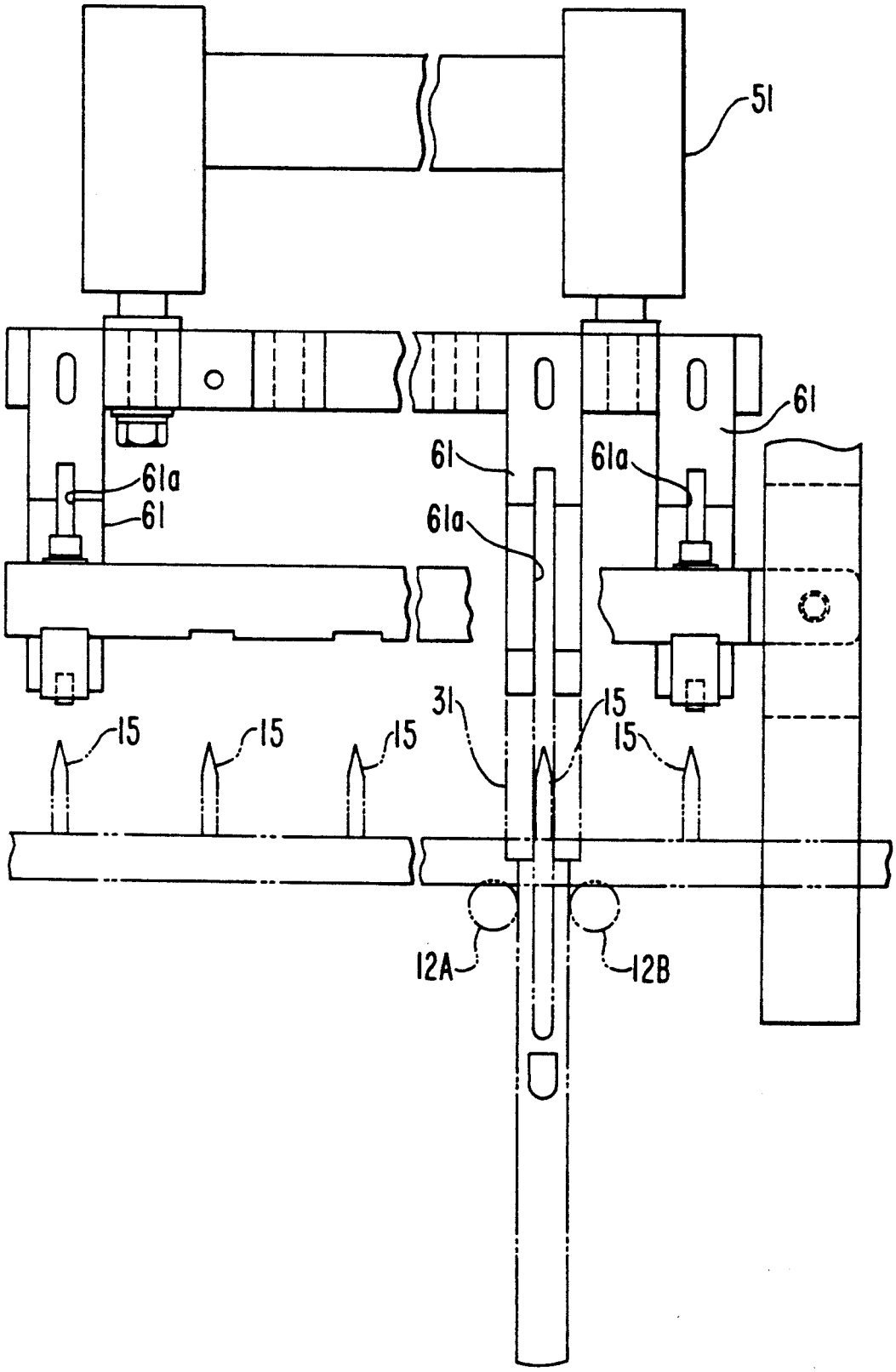
FIG. 7 is a front view showing the separating arms of the second embodiment of FIG. 6.
Figure 8A:
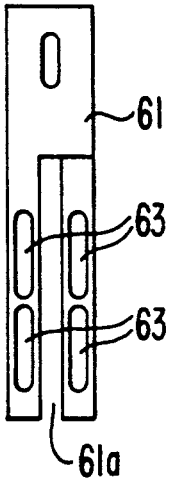
FIGS. 8(*a*) and 8(*b*) are schematic views showing the structure of the separating arm of FIG. 6.
Figure 8B:
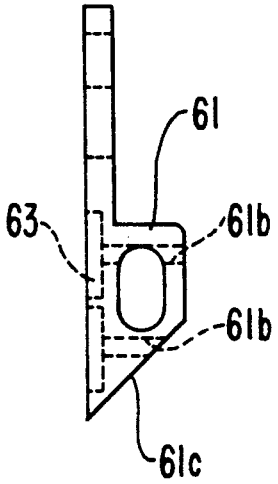

As shown in FIGS. 7 and 8, a separating arm 61 is formed with a slit 61*a* into which a dropper bar 15 is inserted. The separating arm 61 is also provided with one or two magnetic members 63 at each side across the slit 61*a*. A plurality of the separating arms 61 are carried by a movable frame 51 of a threading machine (not shown) and are driven to move upward and downward by the movable frame 51. Each separating arm 61 is also driven to move back and forth along the corresponding dropper bar 15. When the upper front face of the foremost dropper 11*f* is opposed to the magnetic members 63 of the separating arm 61, the foremost dropper 11*f* is attracted and held by the magnetic members 63 of the separating arm 61 located in a predetermined stop position. Then, if the separating arm 61 is moved forward from the predetermined stop position, a dropper separation space between the upper half portions of the foremost dropper 11*f* and the next dropper will be increased. When the separating arm 61 is moved upward, it is separated from the foremost dropper 11*f*, and when the arm 61 is moved downward, the foremost dropper 11*f* with a warp thread passed through the threading bore thereof is removed along a lower inclined surface 61*c* of the separating arm 61.

Figure 9A:
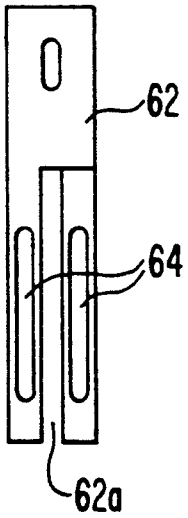
FIGS. 9(*a*) and 9(*b*) are schematic views showing the structure of the removing arm of FIG. 6.
Figure 9B:
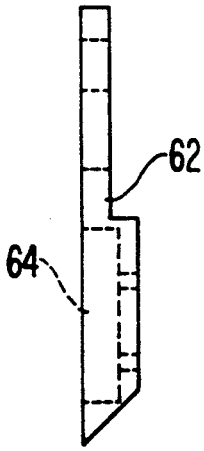

FIGS. 9(*a*) and 9(*b*) illustrate a removing arm 62 with magnetic members 64 that is provided in front of the separating arm 61. The removing arm 62, together with the separating arm 61, is supported on the movable frame 51 of the threading machine, and these arms are movable upward and downward and also backward and forward. The dropper 11*f* that has been threaded is attracted by the magnetic members 64 of the removing arm 62 and moved forward by an amount of a distance Lm (FIG. 6) between the separating and removing arms 61 and 62. Reference numeral 62*a* denotes a slit formed in the removing arm 62, and the dropper bar 15 is inserted into the slit 62*a* of the arm 62. Note that the magnetic members 63 and 64 of the separating and removing arms 61 and 62 are retained to the recesses formed in the arms by magnetic forces and are easily removable.

In the second embodiment of FIGS. 6–9, the foremost dropper 11*f* is attracted and held toward the dropper separating direction by the magnetic members 63 of the separating pawl 61 and moved into a predetermined position by the movement of the movable frame 51. Accordingly, the foremost dropper 11*f* is separated easily and quickly from the next dropper of the dropper group 11G. With a very simple structure that the magnetic members 63 are moved together with the separating arm 61 and the movable frame 51, a sufficient separation space can be obtained only by the bending and elastic recovery of the dropper 11. Therefore, a dropper separation space can be obtained sufficiently in separating a dropper, and a design of the positioning members 41 and 42 can be facilitated. In addition, the foremost dropper 11*f* moved into a predetermined position is removed along the lower inclined surface 61*c* of the separating arm 61 which is lowered in separating and moving the next dropper, so that dropper removing means can be made simple. As a result, there can be achieved a dropper separating mechanism which is small in size and inexpensive.

FIGS. 10–14 illustrate a third embodiment of the dropper separating mechanism in accordance with the present invention. Many of the parts of the third embodiment are identical to corresponding parts of the first embodiment of FIGS. 1–5 and the same reference numerals will be applied to the corresponding parts.

Figure 10:
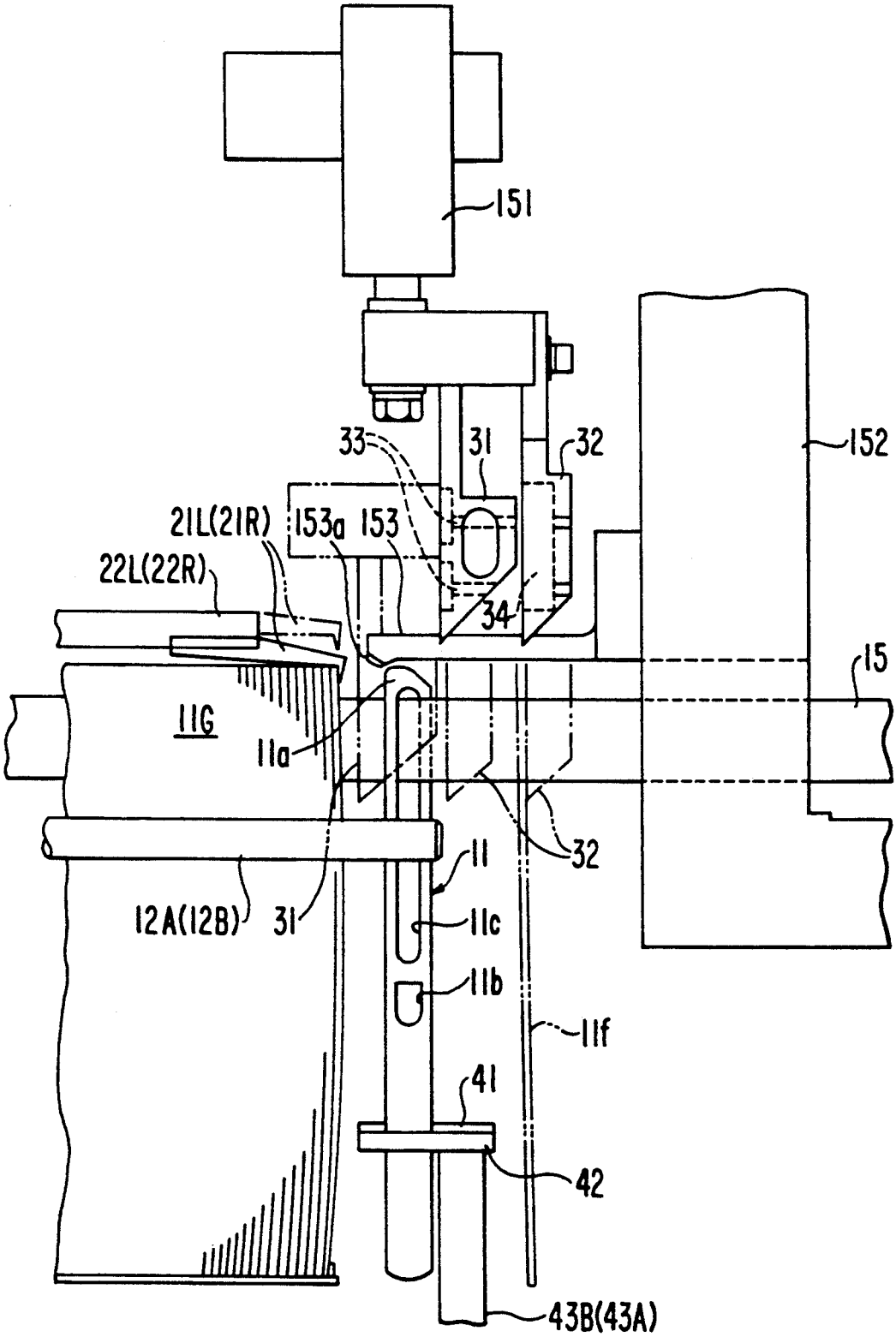
FIG. 10 is a side elevational view showing a third embodiment of the dropper separating mechanism according to the present invention.
Figure 11:
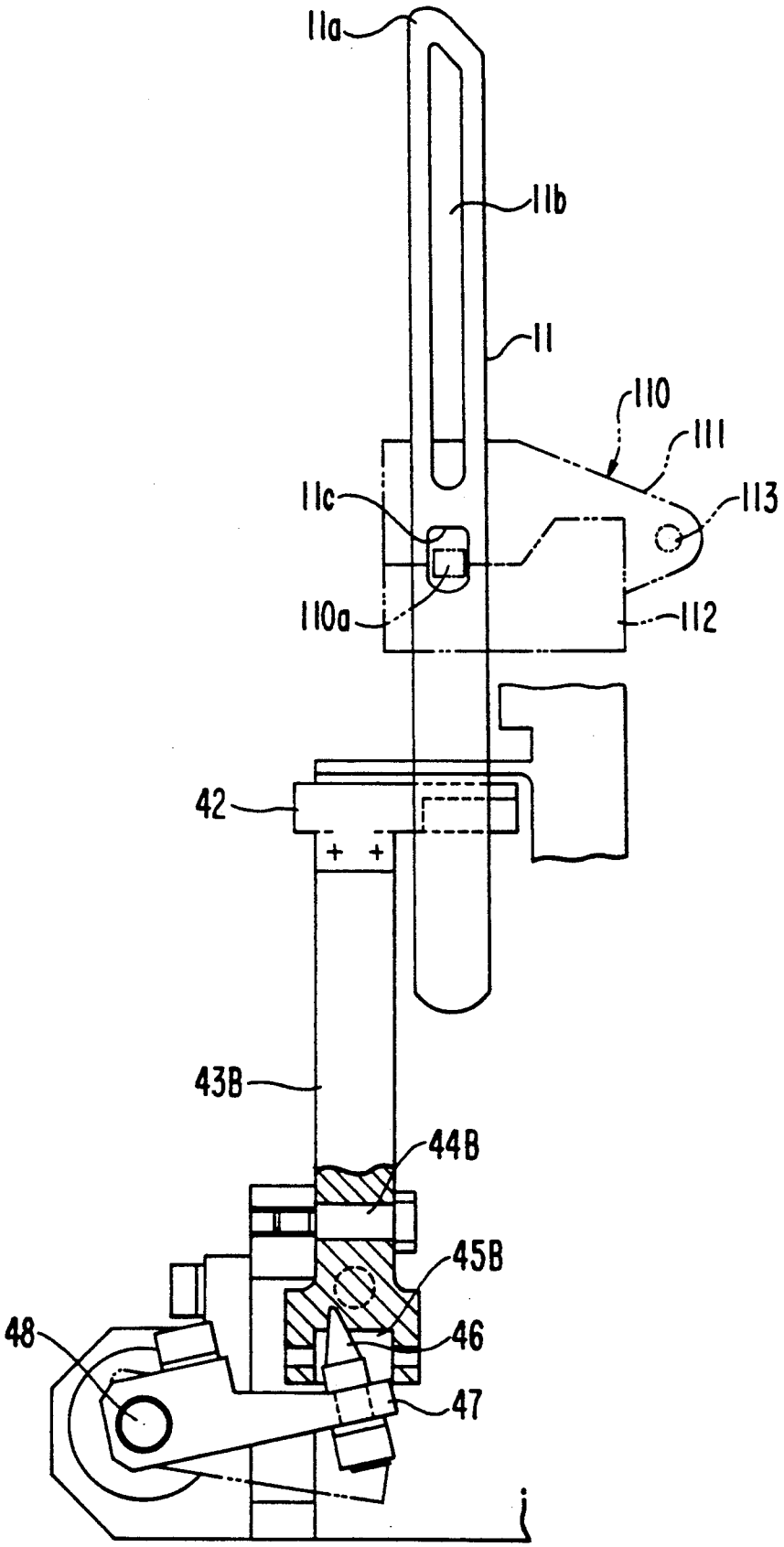
FIG. 11 is an enlarged side view of the dropper positioning member of FIG. 10.

In FIGS. 10 and 11, reference numeral 11 denotes a plurality of droppers which are disposed in a predetermined position of a threading machine (the overall structure is not shown). Each dropper 11 is formed with an asymmetrical mountain portion 11*a* and a threading bore 11*b*. Between the asymmetrical mountain portion 11*a* and the threading bore 11*b*, the dropper 11 is further formed with an elongated bore 11*c*. A plurality of the droppers 11 are alternatively superimposed backward and forward so that the asymmetrical mountain portions 11*a* of two adjacent droppers 11 do not overlap each other, and are aligned and supported on a dropper bar 15 through the elongated bores 11*c*. The aligned droppers 11 are guided by guide pins 12A and 12B and a guide rail 13 and constitute a dropper group 11G. In this embodiment, there are provided six parallel dropper bars 15. For each of these dropper bars, a plurality of droppers are aligned in the same manner as described above. Therefore, a description will hereinafter be given with reference to one dropper group 11G.

A rearmost dropper of the dropper group 11G is pushed with a predetermined pressure from the left direction to the right direction of FIG. 10 by a pusher or pushing means (not shown). A forward movement of the foremost dropper 11*f* is limited by a separating pawl 21L or 21R and two stop pins 14 mounted in the fore end of the guide rail 13. Therefore, a plurality of the droppers are bent proportionally to the predetermined pressure.

The separating pawls 21L and 21R are provided in each row of droppers and are a pair of movable pawls that are movable in the dropper longitudinal direction at the front side of the foremost dropper 11*f*. The separating pawls 21L and 21R, as shown in FIG. 10, are also movable between a dropper stop position (position indicated by the solid line) in which the forward movement of the mountain portion 11*a* of the foremost dropper 11*f* is limited and a dropper separation position (position indicated by the dotted line) in which the mountain portion 11*a* of the foremost dropper 11*f* is separated from the next dropper of the dropper group 11G. If the separating pawl 21L or 21R is moved from the dropper stop position into the dropper separation position, the foremost dropper 11*f* will be changed from its bent state to its straight state, so that a predetermined dropper separation space is formed between the upper half portions of the foremost dropper 11*f* and the next dropper. Note that the separating pawls 21L and 21R are carried by oscillating arms 22L and 22R, respectively, which are oscillated about an oscillation-center shaft 22*c* located above the dropper group 11G. In addition, the oscillating arms 22L and 22R are supported by a fixed frame of the threading machine (not shown) so that the oscillating arms 22L and 22R can be freely oscillated upward and downward. The arms 22L and 22R are oscillated upward and downward upon rotation of a cam (not shown).

The foremost dropper 11*f* separated from the dropper group 11G is pulled forward by magnetic members 33 of the separating arm 31 (movable arm), and the dropper separation space between the separated dropper 11*f* and the next dropper is further increased. This separating arm 31 is carried by a movable frame 151 of a threading machine (not shown) and is driven to move upward and downward by the movable frame 151. The separating arm 31 is also driven to move back and forth along the corresponding dropper bar 15. When the upper front face of the foremost dropper 11*f* is opposed to the magnetic members 33 of the separating arm 31, the foremost dropper 11*f* is attracted and held by the magnetic members 33 of the separating arm 31 located in a predetermined stop position. Then, if the separating arm 31 is moved forward from the predetermined stop position, the dropper separation space between the foremost dropper 11*f* and the next dropper is increased. Within the dropper separation space increased by the separating arm 31, there are inserted first and second positioning members 41 and 42.

Figure 12:
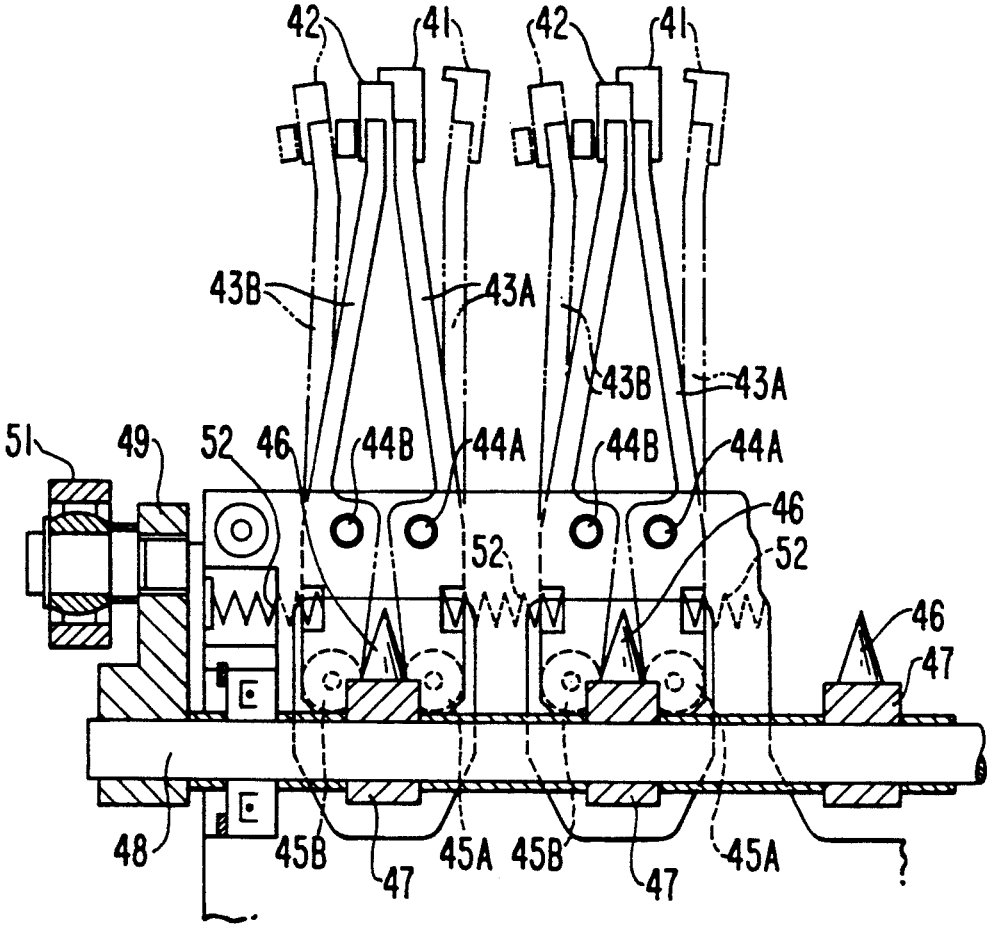
FIG. 12 is an enlarged front view of the dropper positioning members according to the third embodiment of the present invention.
Figure 13:
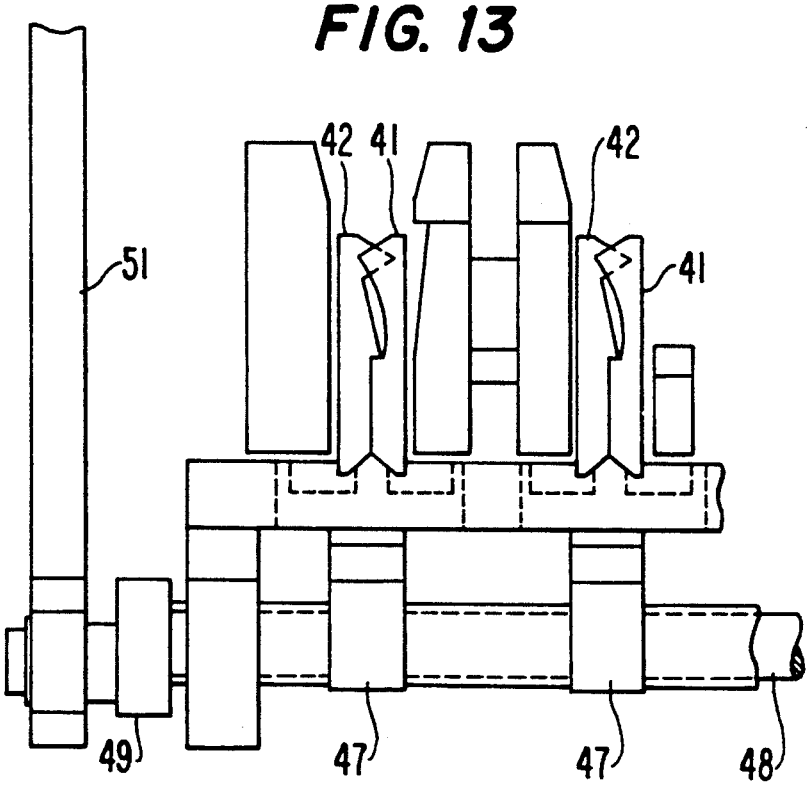
FIG. 13 is an enlarged plan view of the dropper positioning members according to the third embodiment of the present invention.

As shown in FIGS. 11–13, the positioning members 41 and 42 are carried by a pair of oscillating arms 43A and 43B, respectively. The oscillating arms 43A and 43B are supported by a fixed frame 40 through pins 44A and 44B crossing with the threading direction in which the dropper is threaded. That is, the positioning members 41 and 42 are a pair of pawls that are rotatable about a predetermined axis crossing with the threading direction and moved toward and away from each other. If the positioning members 41 and 42 are moved toward each other, the foremost dropper 11*f* will be rotated horizontally and the threading bore 11*b* of the dropper 11*f* will be held in the threading position. The oscillating arms 43A and 43B are also provided at their lower ends with roller members 45A and 45B in parallel to the pins 44A and 44B. The roller members 45A and 45B are brought into engagement with a conical wedge 46. The wedge 46 is fixed to an oscillating arm 47, which has a proximal portion fixedly mounted on a rotational shaft 48. This rotational shaft 48 is driven through a crank arm 49 and a link member 51 by drive means (not shown). If the rotational shaft 48 is rotated, the oscillating arm 47 is oscillated upward and downward through a predetermined angle and the wedge 46 is moved back and forth between the roller members 45A and 45B. When the oscillating arms 43A and 43B are closed against a spring force of a spring 52, the positioning members 41 and 42 are moved toward each other as described above.

Figure 14A:
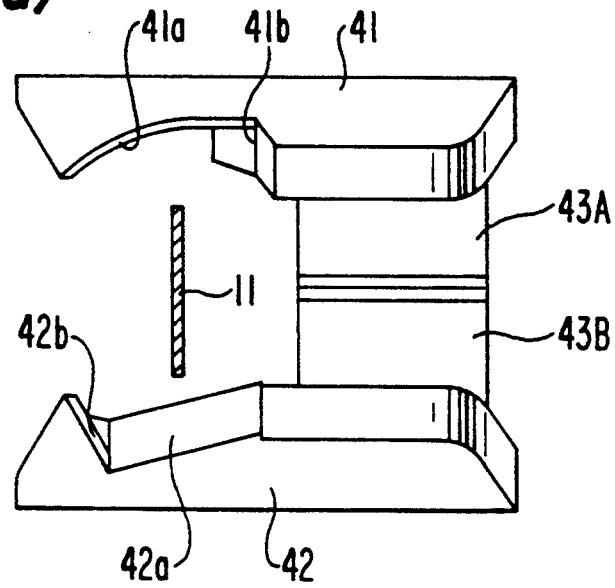
FIG. 14(*a*) is a diagram used to explain how the dropper positioning mechanism is operated, the positioning members being held in an open position.
Figure 14B:
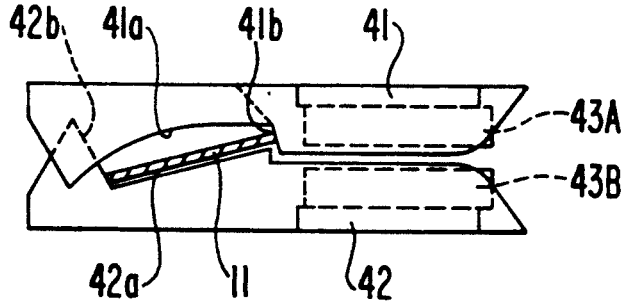
Figure 15A:
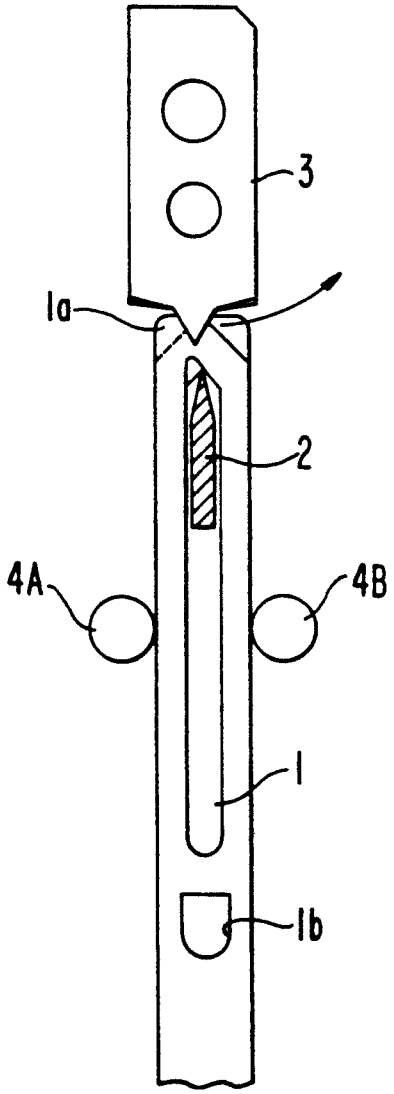
FIG. 15(a) (PRIOR ART)
FIG. 15(*a*) is a front end view showing the dropper separating pawl of a conventional dropper separating mechanism, the foremost dropper to be separated being held by the separating pawl.
Figure 15B:
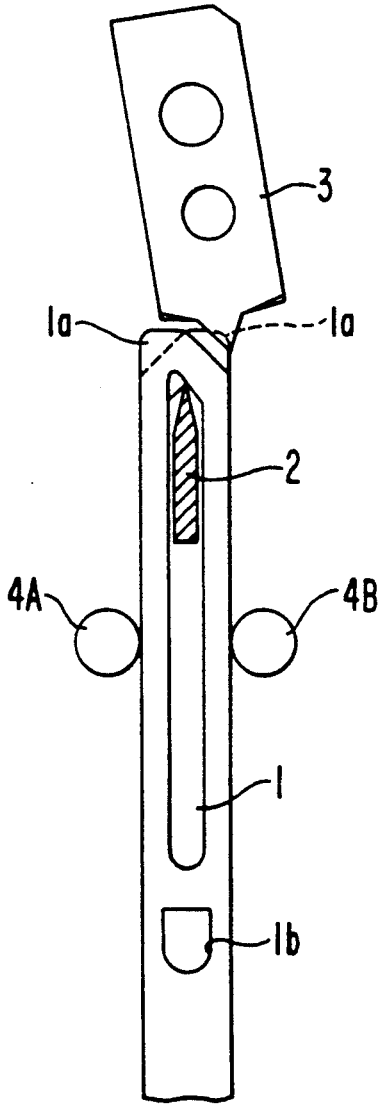
FIG. 15(b) (PRIOR ART)
Figure 16:
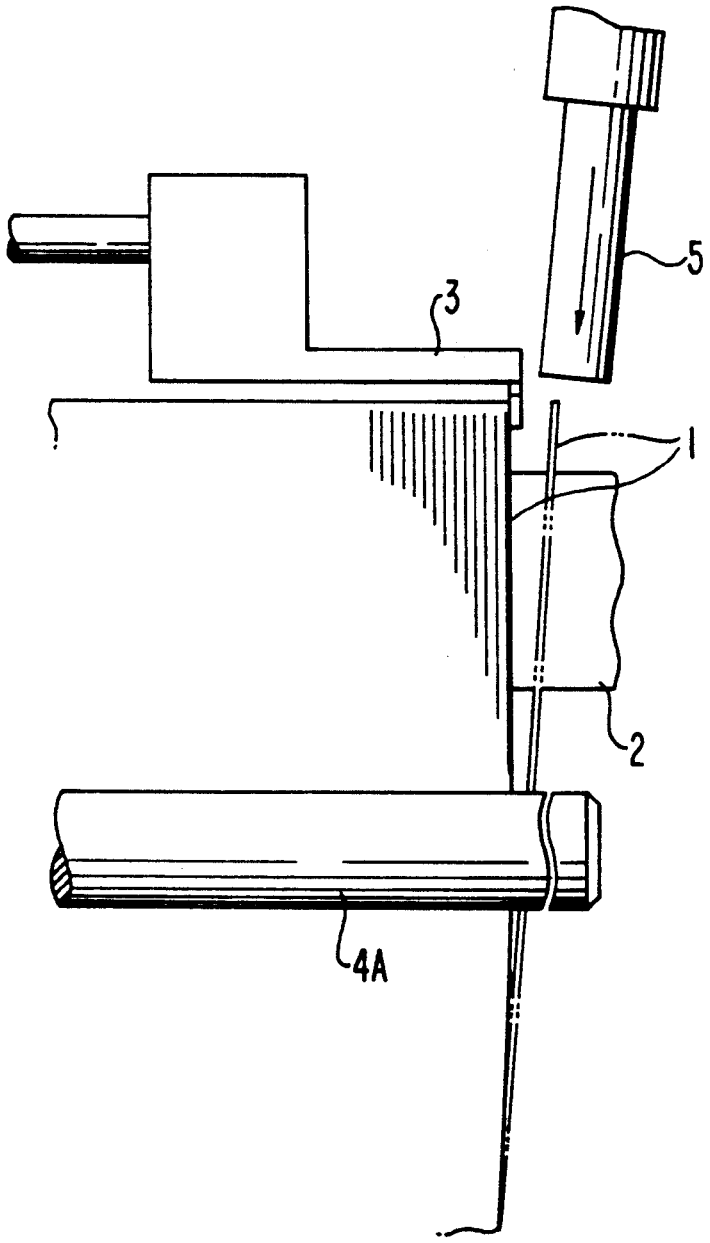
FIG. 16 (PRIOR ART)
FIG. 16 is a side view showing the positioning member of the conventional dropper separating mechanism which is to be inserted onto the foremost dropper.

As shown in FIGS. 14(*a*) and 14(*b*), the positioning members 41 and 42 have guide surfaces 41*a* and 42*a*, respectively. When the positioning members 41 and 42 are moved toward each other, the guide surfaces 41*a* and 42*a* engage with the dropper 11, so that the dropper 11 is slid along the guide surfaces 41*a* and 42*a* and rotated horizontally. The dropper 11 thus positioned can be threaded through the threading bore 11*b* thereof. The first positioning member 41 further has a first stop portion 41*b* by which the sliding motion of the dropper 11 along the guide surface 41*a* is stopped, and the second positioning member 42 has a second stop portion 42*b* by which the sliding motion of the dropper 11 along the guide surface 42*a* is stopped. As shown in FIG.

14(*b*), the sliding motion of the dropper 11 is stopped at its one end by the first stop portion 41*b* of the first positioning member 41 and at its the other end by the second stop portion 42*b* of the second positioning member 42.

A removing arm 32 with a magnet 34 (which constitutes a part of the movable arm) is provided in front of the separating arm 31, and the arms 31 and 32 are supported on a movable frame 151 of the threading machine and movable upward and downward and also backward and forward. The dropper 11*f* that has been threaded is attracted by the magnet 34 of the removing arm 32 and moved forward by the removing arm 32.

In FIG. 10, reference numeral 152 denotes a fixed frame of the threading machine supporting the dropper bar 15. The fixed frame 152 has attached thereto a return-prevention member 153 which has an engagement portion 153*a* engageable with the upper end of the separated dropper 11*f*. The separated dropper 11*f* is prevented from returning back to the dropper group 11G by the engagement portion 153*a* of the return-prevention member 153. In FIG. 11, reference numeral 110 denotes a plurality of threading nozzle units which are provided in parallel to and between the dropper rows arranged in parallel. Each threading nozzle unit 110 has nozzle segments 111 and 112 rotatably supported on a hinge portion 113. By these nozzle segments, the threading nozzle unit 110 can be opened and closed for the dropper removing operation after the threading operation. The nozzle segments 111 and 112 have recesses which form a nozzle bore 110*a* when they are closed. The nozzle bore 110*a*, as shown in FIG. 11, is sized such that it is located within the threading bore 11*b* of the dropper 11 held in the threading position by the positioning members 41 and 42.

The operation of the dropper separating mechanism of FIGS. 10–14 will hereinafter be described in detail.

Prior to the operation of the threading machine, a plurality of the droppers 11 are alternatively superimposed backward and forward so that the asymmetrical mountain portions 11*a* of two adjacent droppers 11 do not overlap each other, and are aligned. The aligned droppers 11 are guided by the guide pins 12A, 12B and the guide rail 13 and supported on the dropper bar 15 through the elongated bores 11*c* of the droppers 11. Then, the rearmost dropper of this dropper group 11G are pushed forward by the pushing means, and the forward movement of the foremost dropper 11*f* is limited at the upper and lower ends thereof by one of the separating pawls 21L and 21R and by the stop pins 14 mounted in the guide rail 13. As a result, the aligned droppers 11G are bent proportionally to a pressure of the pushing means.

If in the bent state of the droppers the pawl driving cam 26 rotates, the separating pawl 21L or 21R is disengaged from the mountain portion 11*a* of the foremost dropper 11*f*. The foremost dropper 11*f* is then released from its bent state and returns back to its straight state. The foremost dropper 11*f* in the straight state is attracted and bent forward by the magnets 33 of the separating arm 31. At that time, there is formed a predetermined dropper separation space between the upper half portion of the dropper 11*f* attracted to the separating arm 31 and the upper half portion of the following dropper group 11G. The separating arm 31 is then moved forward and the dropper separation space is further increased.

In this state, the upper half portion of the separated dropper 11*f* is positioned between the positioning members 41 and 42, as shown in FIG. 14(*a*). The positioning members 41 and 42 are then inserted into the increased dropper separation space, and moved toward each other, so that the upper half portion of the dropper 11*f* is held in position. That is, if the oscillating arm 47 is oscillated downward by the rotational shaft 48 and the wedge 46 brought into engagement with the roller members 45A and 45B is moved back, the positioning members 41 and 42 are moved toward each other. At this time, the dropper 11*f* is slid on and along the first and second guide surfaces 41*a* and 42*a* and is substantially horizontally rotated from the position of FIG. 14(*a*) into the position of FIG. 14(*b*). Therefore, the dropper 11 is hardly damaged even when the positioning members 41 and 42 are operated at high speeds and a periodical cleaning of the positioning members 41 and 42 is not needed since the first and second guide surfaces 41*a* and 42*a* can be separated.

In addition, when the positioning members 41 and 42 are closed as shown in FIG. 14(*b*), the opposite side portions of the dropper 11 are firmly retained on the first and second stop portions 41*b* and 42*b*, the dropper can be held in a predetermined position accurately, so an accuracy in the positioning of a dropper can be enhanced. Furthermore, in the third embodiment of FIGS. 10–14, the first and second positioning members 41 and 42 are rotated about the pins 44A and 44B crossing with a predetermined threading path and moved toward and away from each other along the threading path, so the positioning members 41 and 42 can be driven by a single drive system. As a result, a drive system for the positioning members can be made structurally simple.

While the subjection invention has been described with relation to the preferred embodiments, various modifications and adaptations thereof will now be apparent to those skilled in the art. All such modifications and adaptations as fall within the scope of the appended claims are intended to be covered thereby.

What we claim is:

1. A dropper separating mechanism comprising:

droppers each having an asymmetrical mountain portion at an upper end thereof and alternatively superimposed in a first direction so that the asymmetrical mountain portions of two adjacent droppers do not overlap each other;

pushing means provided in a rear side of said droppers to push said droppers forward from said rear side;

a pair of movable pawls provided so that they are movable in a second direction perpendicular to said first direction;

means to oscillate said pair of movable pawls between a first position in which the mountain portion of a foremost dropper of said droppers is limited in forward movement and a second position in which said mountain portion of said foremost dropper is separated; and a fixed pawl to limit a forward movement of a lower end of said foremost dropper.

2. A dropper separating mechanism as set forth in claim 1, wherein said means to oscillate comprises means for holding one of said movable pawls in said first position, and simultaneously holding the other of said movable pawls in said second position.

3. A dropper separating mechanism as set forth in claim 1, wherein said movable pawls are supported by arm members, respectively, which oscillate about their axes located above said droppers.

4. A dropper separating mechanism comprising:

droppers each having an asymmetrical mountain portion at an upper end thereof and alternatively superimposed in a first direction so that the asymmetrical mountain portions of two adjacent droppers do not overlap each other;

pushing means provided in a rear side of said droppers to push said droppers forward from said rear side;

a pair of movable pawls provided so that they are movable in a second direction perpendicular to said first direction;

means to oscillate said pair of movable pawls between a first position in which the mountain portion of a foremost dropper of said droppers is limited in forward movement and a second position in which said mountain portion of said foremost dropper is separated;

a fixed pawl to limit a forward movement of a lower end of said foremost dropper;

a magnetic member for attracting said foremost dropper in a direction in which said foremost dropper is separated; and a movable arm supporting said magnetic member, said movable arm comprising means for moving said foremost dropper attracted by said magnetic member into a predetermined position.

5. A dropper separating mechanism as set forth in claim 4, wherein said movable arm comprises means for removing said foremost dropper from said predetermined position while a next dropper of said droppers is separated and moved.

6. A dropper separating mechanism as set forth in claim 5, wherein said movable arm is formed with a lower inclined surface.

* * * * *